US008997670B2

(12) United States Patent
Book et al.

(10) Patent No.: US 8,997,670 B2
(45) **Date of Patent: *Apr. 7, 2015**

(54) CONVEYANCE SYSTEM THAT TRANSPORTS FABRIC

(76) Inventors: Wayne J. Book, Atlanta, GA (US); James D. Huggins, Marietta, GA (US); Stephen L. Dickerson, Atlanta, GA (US)

( * ) Notice: Subject to any disclaimer, the term of this patent is extended or adjusted under 35 U.S.C. 154(b) by 1046 days.

This patent is subject to a terminal disclaimer.

(21) Appl. No.: 13/050,913

(22) Filed: Mar. 17, 2011

(65) Prior Publication Data

US 2012/0061441 A1 Mar. 15, 2012

Related U.S. Application Data

(60) Provisional application No. 61/315,247, filed on Mar. 18, 2010.

(51) Int. Cl.

| | |
|---|---|
| ***D05B 27/00*** | (2006.01) |
| ***D05B 27/06*** | (2006.01) |
| ***D05B 19/16*** | (2006.01) |
| ***D05B 27/08*** | (2006.01) |

(52) U.S. Cl.
CPC ..... *D05B 27/06* (2013.01); *D05B 19/16* (2013.01); *D05B 27/08* (2013.01)

(58) Field of Classification Search
USPC ..... 112/303, 304, 309, 312, 314, 318, 322, 112/324, 470.03, 470.13, 470.32
See application file for complete search history.

(56) References Cited

U.S. PATENT DOCUMENTS

| | | | |
|---|---|---|---|
| 3,721,809 | A | 3/1973 | Strandberg, Jr. et al. |
| 4,404,919 | A | 9/1983 | Martell et al. |
| 4,632,046 | A | 12/1986 | Barrett et al. |
| 4,658,741 | A | 4/1987 | Jehle et al. |
| 5,416,593 | A | 5/1995 | Vercruysse |
| 6,220,687 | B1 | 4/2001 | Takahashi et al. |
| 6,499,513 | B1 | 12/2002 | Couch |
| 2002/0020332 | A1 | 2/2002 | Hartsell et al. |
| 2004/0129190 | A1 | 7/2004 | Sawada et al. |

OTHER PUBLICATIONS

Sundaresan Jayaraman, US Apparel Automation Initiatives in a Nutshell, Jul. 11, 2007.
Chris Byrne, The Impact of New Technology in the Clothing Industry: Outlook to 2000, This paper originally produced for Internat'l Labour Office in Geneva.
John E. Berkowitch, Trends in Japanese Textile Technology, Prepared for U.S. Dept. of Commerce, Office of Technology Policy, Asia-Pacific Tech. Program, Sep. 1996.

*Primary Examiner* — Tejash Patel
(74) *Attorney, Agent, or Firm* — Minh N. Nguyen; Next IP Law Group LLP

(57) ABSTRACT

A conveyance system that transports fabric comprises a work space having a surface that the fabric can be transports across, and at least one budger that moves and/or provide force to the fabric in a servo controlled motion.

20 Claims, 13 Drawing Sheets

CONVEYANCE SYSTEM THAT TRANSPORTS FABRIC

CROSS REFERENCE TO RELATED APPLICATIONS

This application claims the benefit of U.S. provisional application entitled, "Refinements in Automated Sewing," having Ser. No. 61/315,247, filed on Mar. 18, 2010, which is entirely incorporated herein by reference. This application is related to U.S. patent application entitled, "A FEED MECHANISM THAT ADVANCES FABRIC", having Ser. No. 13/050,919, filed on Mar. 17, 2011.

BACKGROUND

Clothing is one of the three basic necessities of human life and a means of personal expression. As such, clothing or garment manufacturing is one of the oldest and largest industries in the world. However, unlike other mass industries such as the automobile industry, the apparel industry is primarily supported by a manual production line. Currently a sewing machine uses what is known as a feed dog to move the fabric through the sewing head relying on the operator to maintain the fabric orientation and keep up with the feed rate, also operator controlled. Previous attempts at automated sewing used the sewing dogs on a standard sewing machine and had a robot perform exactly the operations a human user would perform.

The need for automation in garment manufacturing has been recognized by many since the early 1980s. During the 1980s, millions of dollars were spent on apparel industry research in the United States, Japan and industrialized Europe. For example, a joint $55 million program between the Ministry of International Trade and Industry (MITI) and industry, called the TRAAS program, was started in 1982. The ultimate goal of the program was to automate the garment manufacturing process from start, with a roll of fabric, to finish, with a complete, inspected garment. While the project claimed to be successful, and did demonstrate a method to produce tailored women's jackets, it failed to compete with traditional methodologies.

Draper Laboratories in the U.S. received with $25 million of support from the government and industry with the goal of automating parts of the sewing process, beginning with setting a sleeve into a coat and then moving to automated seaming. In Europe, the BRITE project put millions of dollars towards automated sewing. Neither program resulted in successfully automating the entire process, although some minor gains were made.

Desirable in the art is an improved automated sewing machine that would improve upon the conventional automated sewing designs.

BRIEF DESCRIPTION OF THE DRAWINGS

The accompanying drawings illustrate preferred embodiments of the invention, as well as other information pertinent to the disclosure, in which.

DETAILED DESCRIPTION

This disclosure is related to a system of automation, particularly in the area of placing each stitch near the correct threads of the warp and weft (fill) of the component pieces of fabric, that can be achieved by novel sensing and material handling devices. This can facilitate in achieving an automated garment making machine that produces garments with a proper shape when draped over the wearer's body.

This disclosure is related to refinements useful for automating a sewing process that is a subject of a patent application having U.S. Ser. No. 12/047,103, entitled "Control Method for Garment Sewing", filed on Mar. 12, 2008 having an inventor, Stephen Lang Dickerson, which is entirely incorporated herein by reference. The '103 patent application discloses a sewing process based on a metric of cloth dimensions that does not change with fabric distortion. This allows control of the sewing or similar connection process that is indifferent to fabric distortions. However, in implementation of automated garment manufacturing, technical challenges include fabric actuation and sensing techniques that have robust accuracy and ability to reliably control multiple sheets of fabric. To address these issues, among others, the disclosed refinements below by which automated sewing can be feasibly realized focus on a subset of automated sewing, for example, the precise actuation and sensing of fabric near and remote from the sewing head during the sewing process.

Exemplary systems are discussed with reference to the figures. Although these systems are described in detail, they are provided for purposes of illustration only and various modifications are feasible. In addition, examples of flow diagrams of the systems are provided to explain the manner in which the making of garments can be accomplished.

Figure 1:
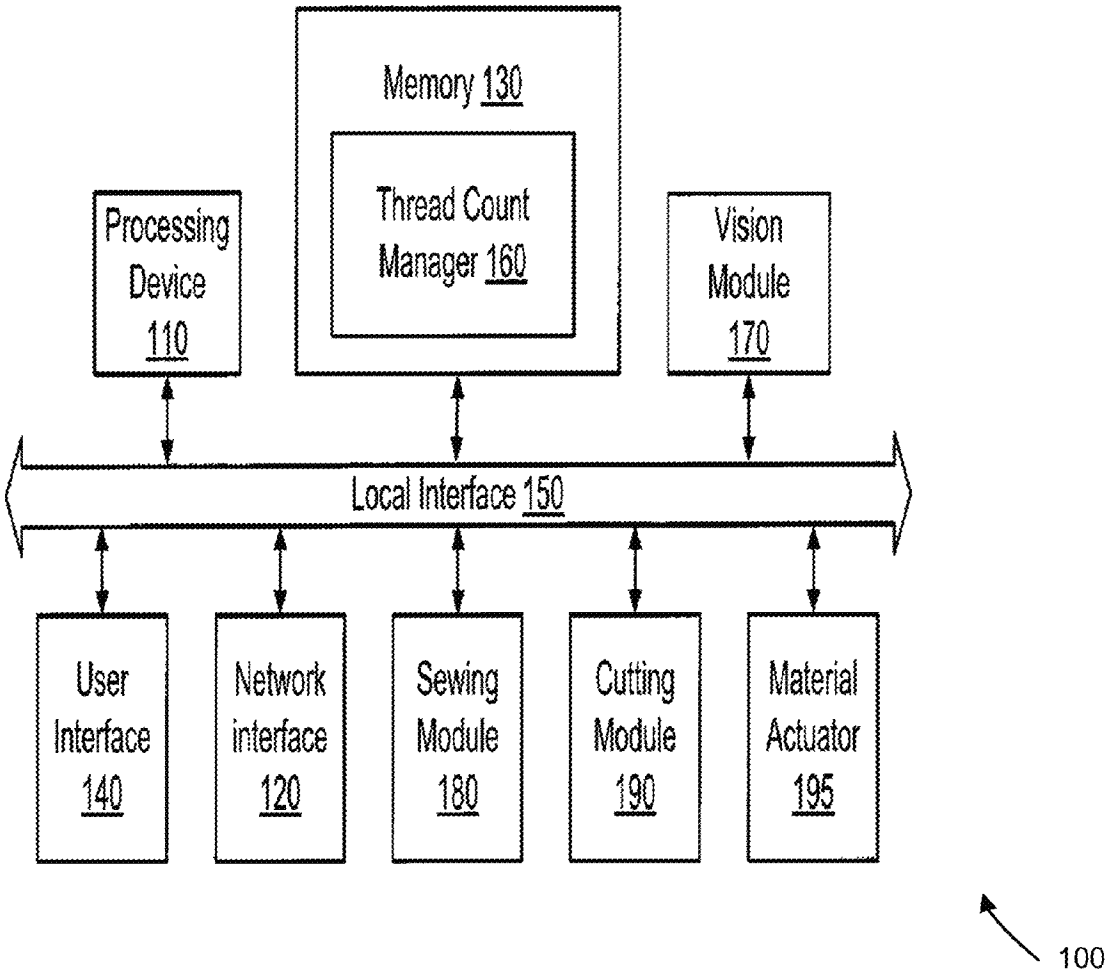
FIG. 1 is a block diagram that illustrates an embodiment of a system that makes garment.

FIG. 1 is a block diagram that illustrates an embodiment of a system 100 that makes garment. As indicated in FIG. 1, the system 100 comprises a processing device 110, memory 130, one or more user interface devices 140, one or more networking devices 120, one or more vision modules 170, one or more sewing modules 180, one or more cutting modules 190, and one or more material actuators 195, each of which is connected to a local interface 150. The local interface 150 can be, for example, but not limited to, one or more buses or other wired or wireless connections, as is known in the art. The local interface 150 may have additional elements, which are omitted for simplicity, such as controllers, buffers (caches), drivers, repeaters, and receivers, to enable communications. Further, the local interface 150 may include address, control, and/or data connections to enable appropriate communications among the aforementioned components.

The processing device 110 can include any custom made or commercially available processor, a central processing unit (CPU) or an auxiliary processor among several processors associated with the camera 100, a semiconductor based microprocessor (in the form of a microchip), or a macroprocessor. Examples of suitable commercially available microprocessors are as follows: a PA-RISC series microprocessor from Hewlett-Packard Company, an 80X86 or Pentium series microprocessor from Intel Corporation, a PowerPC microprocessor from IBM, a Sparc microprocessor from Sun Microsystems, Inc, or a 68xxx series microprocessor from Motorola Corporation.

The networking devices 120 comprise the various components used to transmit and/or receive data over the network, where provided. By way of example, the networking devices 120 include a device that can communicate both inputs and outputs, for instance, a modulator/demodulator (e.g., modem), a radio frequency (RF) or infrared (IR) transceiver, a telephonic interface, a bridge, a router, as well as a network card, etc. The camera 100 can further includes one or more I/O devices (not shown) that comprise components used to facilitate connection of the camera 100 to other devices and therefore, for instance, comprise one or more serial, parallel, small system interface (SCSI), universal serial bus (USB), or IEEE 1394 (e.g., Firewire™) connection elements.

The vision module 170 can facilitate counting threads of a garment material as well as inspecting for defects on the garment material during a cutting operation. The vision module 170 can further facilitate detecting markings on the garment material before cutting or sewing the garment material. The material actuator 195 facilitates moving the garment materials during the cutting and sewing operations. The cutting and sewing modules 180, 190 facilitate cutting and sewing the garment materials together, respectively. In one embodiment, the sewing module 180 can be configured to sew the perimeter or markings on the garment material based on tracking a pattern that amounts to following a predetermined sequence of thread counts and/or the orientation of threads. Alternatively or additionally, the sewing module 180 can sew two or more pieces of material together based on a predetermined sequence of thread counts and/or the orientation of threads for both parts, resulting in a sewn garment. Alternatively or additionally, the thread count of a cut piece is measured after cutting by the cutting module 190 and used by the sewing module 180 to sew two or more pieces together based on a calculated sequence of thread counts and/or the orientation of threads for both parts resulting in a sewn garment.

The memory 130 can include any one or a combination of volatile memory elements (e.g., random access memory (RAM, such as DRAM, SRAM, etc.)) and nonvolatile memory elements (e.g., ROM, hard drive, tape, CDROM, etc.). The one or more user interface devices comprise those components with which the user (e.g., administrator) can interact with the camera 100.

The memory 130 normally comprises various programs (in software and/or firmware) including at least an operating system (O/S) (not shown) and a thread count manager 160. The O/S controls the execution of programs, including the thread count manager 160, and provides scheduling, input-output control, file and data management, memory management, and communication control and related services. The thread count manager 160 facilitates the process for cutting and sewing garment material based on thread counts and/or orientation of the threads. For example, the thread count manager 160 includes instructions stored in the memory 130. The instructions comprise logic configured to instruct the sewing module 180 to sew the garment material based on counting threads of the garment material. Optionally, the instructions comprise logic configured to instruct the sewing module 180 to sew the garment material based on the orientation of the threads. Yet another option, the instructions comprise logic configured to instruct the cutting module 190 to cut the garment material based on counting the threads of the garment material. Further details relating to the thread counting manager 160 is further described in U.S. patent Ser. No. 12/047,103, entitled "Control Method for Garment Sewing".

The thread count manager 160 can be implemented by any computer-readable medium for use by or in connection with any suitable instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can store, communicate, propagate, or transport the program for use by or in connection with the instruction execution system, apparatus, or device.

The computer readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM, EEPROM, or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

A nonexhaustive list of examples of suitable commercially available operating systems is as follows: (a) a Windows operating system available from Microsoft Corporation; (b) a Netware operating system available from Novell, Inc.; (c) a Macintosh operating system available from Apple Computer, Inc.; (e) a UNIX operating system, which is available for purchase from many vendors, such as the Hewlett-Packard Company, Sun Microsystems, Inc., and AT&T Corporation; (d) a LINUX operating system, which is freeware that is readily available on the Internet; (e) a run time VxWorks operating system from WindRiver Systems, Inc.; or (f) an appliance-based operating system, such as that implemented in handheld computers or personal data assistants (PDAs) (e.g., Palm OS available from Palm Computing, Inc., and Windows CE available from Microsoft Corporation, and Google's desktop OS Chrome). The operating system essentially controls the execution of other computer programs, such as the thread count manager 160, and provides scheduling, input-output control, file and data management, memory management, and communication control and related services.

Figure 2:
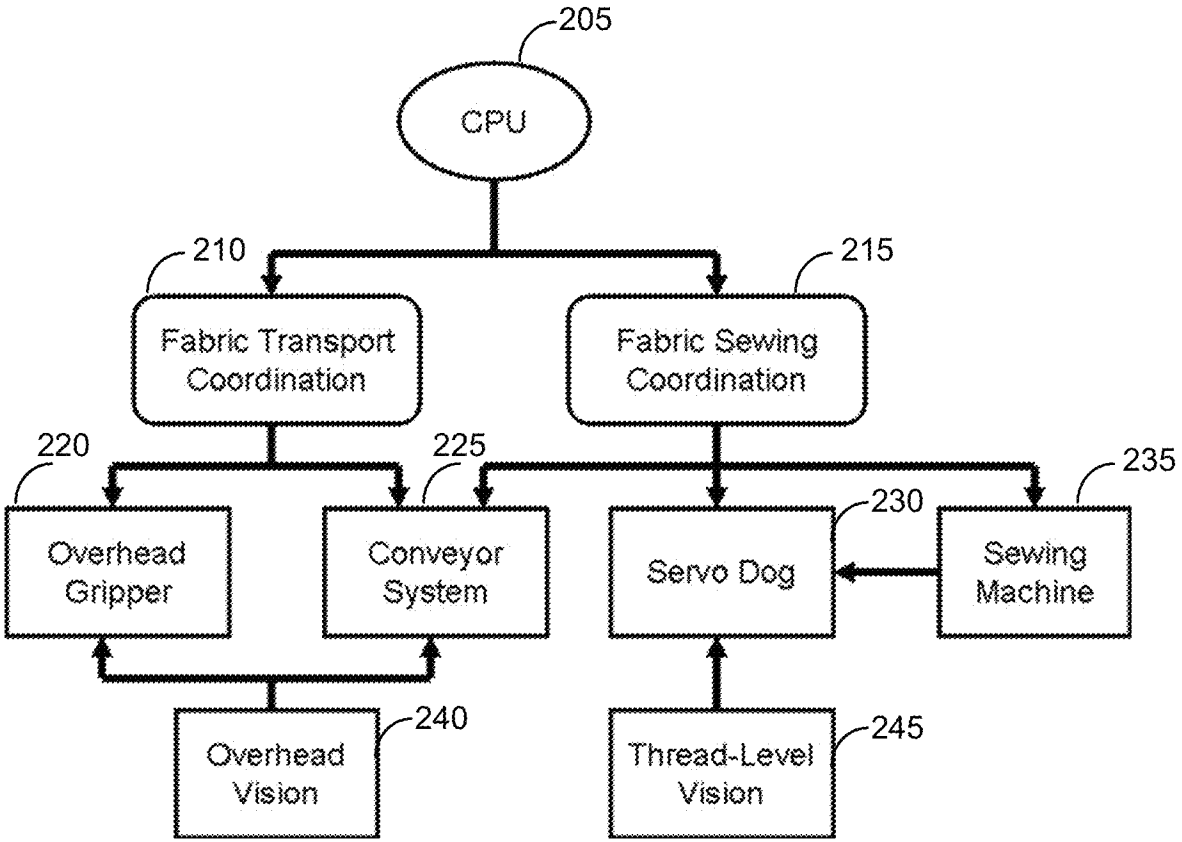
FIG. 2 is a block diagram that illustrates an embodiment of a control hierarchy, integrating various components of a system, such as that shown in FIG. 1.

FIG. 2 is block diagram that illustrates an embodiment of a control hierarchy, integrating various components of a system 100, such as that shown in FIG. 1. The various components can include, not are not limited to, a central processing unit (CPU) 205, fabric transport coordination module 210, fabric sewing coordination module 215, overhead gripper 220, conveyance system 225, servo dog(s) 230, sewing machine(s) 235, overhead vision module 240, and thread-level vision module 245. The term "dogs" is a common term for a feed mechanism that advances fabric 830 (FIG. 8) between stitches, assumed to be done with a needle 825 (FIG. 8), by using a small pressure plate that moves in an oscillatory manner.

To sew two pieces of fabric 830 together, a number of processes must be coordinated. The CPU 205 processes the information and facilitates coordinating the various components 210, 215, 220, 225, 230, 235, 240, 245 to sew two pieces of fabric 830 together. An example of the coordinated process is provided below. The individual sheets of fabric 830 can be transported to the sewing machine 235 and placed flat on a table surface 335 (FIG. 3) by the fabric transport coordination module 210, overhead gripper 220, and conveyance system 225. The two sheets of fabric 830 can be aligned properly and moved to a sewing head 815 (FIG. 8) of the sewing machine 235. The fabrics 830 are then fed through the sewing machine 235 and sewn together by the fabric sewing coordination module 215, sewing machine(s) 235, overhead vision module 240, and thread-level vision module 245. While this is occurring, each sheet can be maintained in proper alignment with respect to the sewing head 815 and with respect to each other and can be fed at the proper rate and maintained at the proper tension. At the end of the seam, the seam can be serged to complete the seam and to prevent it from coming undone. Finally, the sewing thread can be cut and the finished piece can be transported to the next stage of the process by the fabric transport coordination module 210, overhead gripper 220, and conveyance system 225.

To efficiently and reliably complete these varied tasks, an integrated system using multiple types of sensors and actuators is proposed as summarized as follows. The overhead gripper 220 or pick-and-place robot with a special end effector can be used to pull individual plies of fabric 830 from a stack of pre-cut fabric pieces. An off-the-counter overhead gripper 220 can be used and is fairly conventional; hence the overhead gripper 220 will not be further described herein.

The fabric transport coordination module 210 can control the conveyance system 225 that can include an array of small, inexpensive "budgers" 300 (FIG. 3) that provide a useful method for transporting the fabric 830 to the sewing head 815 (FIG. 8) while ensuring that the fabric 830 lays flat and in the correct orientation. Each budger 300 includes a steered ball 305 driven by at least one motor 310 to rotate the ball 305 in two perpendicular axes. Traction between the fabric 830 and the ball 305 is enhanced by a slight vacuum drawing a flow of air through the fabric 830 via a series of holes 325 in the ball 305. The budger 300 is further described in connection with FIG. 3.

The overhead vision module 240 can provide position feedback of the fabric 830 as the fabric 830 is transported to the sewing head 815. The position feedback of the fabric 830 can be used to control the budger 300 that moves the fabric 830 toward the sewing head 815. Tracking the large motions of a piece of fabric 830 can be used to deliver the fabric 830 to the sewing head 815 accurately. Alternatively or additionally, identifiable markings, or fiducials, can be placed on the fabric 830 to facilitate with tracking the fabric 830, although existing features (e.g., buttons or ornamental designs) on the fabric 830 can also be used. The overhead vision module 240 can track these individual fiducials and estimate the position and wrinkle of the fabric 830.

Estimation can be improved with a suitable model of the fabric behavior. A Kalman filter or Extended Kalman Filter (EKF) is commonly used to estimate the position of a body in the presence of noise based on a model of the fabric 830. An example of the model of the fabric 830 includes a 2-dimensional x, y, and theta displacements and their derivatives of the center of mass of the fabric 830. Another example of the model of the fabric 830 includes a 2-dimensional finite element mesh where the nodes represent the states of the fabric 830.

An experiment was conducted to track the fabric using the overhead vision module 240. In this experiment, the tracking process includes the following events: 1) initialization, 2) state prediction, 3) measurement with data association and 4) state correction. The initialization stage processes the initial frames of the sequence. Background subtraction can be used to identify the fabric 830 (foreground) from the background of the conveyance system 225. Based on the assumption of background subtraction, the region of interest (ROI) can be identified using the overhead vision module 240. The tracking process was implemented in Matlab, a well-known signal processing software, for this experiment.

The estimation process can be carried out based on various assumptions and with various levels of calculation burden. Once the frames are read into Matlab, the algorithm can be run with the following criteria:

no assumed model or force only the assumed force an assumed force and the Extended Kalman Filter (EKF) for the rigid model only no assumed force and the EKF for the rigid model only an assumed force and the EKF for the mesh model no assumed force and the EKF for the mesh model For the rigid assumption, errors were reduced by EKF where the error remains in the vicinity of 2 pixels. This experiment shows that the overhead vision module 240 using the above methods, criteria, and processes can be adequate for tracking the fabric 830 unless the fabric 830 is prone to buckling as is the case when the direction of motion is reversed.

At the sewing head 815 of the sewing machine 235, a current sewing machine feed mechanism can be modified to replace the standard sewing dogs and user with servo controlled dogs 230. By using the servo controlled dogs 230 as the method by which to control the fabric 830, the difficulties of fabric feed rate, tension control, and fabric position control can all be more adequately addressed. The budgers 300 provide the large fabric motions that the human would normally provide, and hence the budgers 300 and dogs 230 are coordinated by the fabric transport coordination and fabric sewing coordination modules 210, 215, and monitored for position feedback by the overhead vision and thread-level vision modules 240, 245 to help the process of making a garment.

For the actuators 1005 (FIG. 10) at the sewing head 815 to achieve high position accuracy, the thread-level vision module 245 can provide fabric position feedback by tracking individual threads in the fabric 830. Therefore, the position of the fabric 830 can be measured in threads rather than millimeters or inches. In the previous research, fabric position is based on the shape of the fabric 830 relative to a global coordinate system. As such, any fabric deformation can result in position error. Using the fabric's threads for position detection can avoid errors due to deformation and problems due to noise in the fabric edge. An example of an algorithm for the thread-level vision module 245 is further described in connection with FIG. 4.

Figure 3:
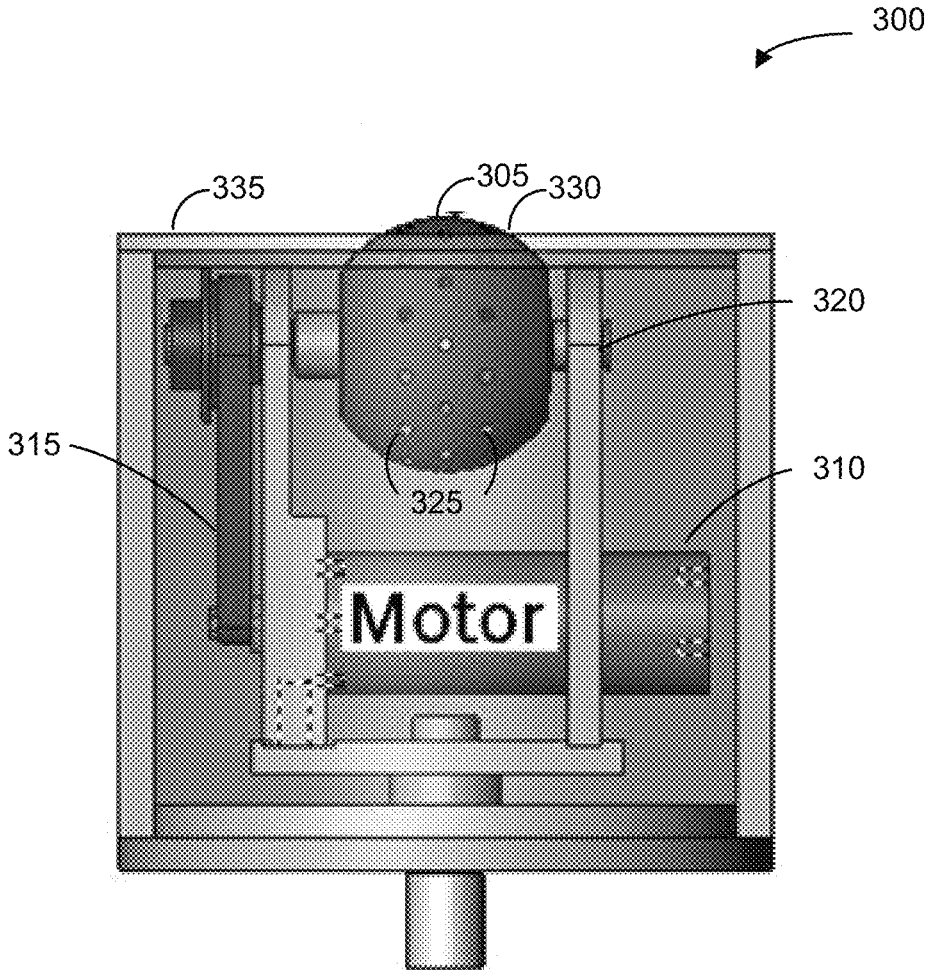
FIG. 3 is a front view that illustrates an embodiment of a budger, which is part of a conveyance system, such as that shown in FIG. 2.

FIG. 3 is a front view that illustrates an embodiment of a budger 300 that is part of a conveyance system 225, such as that shown in FIG. 2. The budger 300 includes at least one motor 310 (e.g., stepping motor and dc motor) that spins a perforated ball or cylinder 305 and controls the angle of a spinning axis 320 via mechanical linkage 315, such as a flexible thread or cord. The perforated ball 305 partially protrudes out of an opening 330 of a table surface 335. The budger 300 can be located in a stationary position relative to the sewing head 815. A fabric 830 (FIG. 8) can be moved across the table surface 335 by spinning the perforated ball 305. The budger 300 creates a slight vacuum between the fabric 830 and the ball 305 to maintain a normal force high enough to move the fabric 830. The vacuum pulls air through the holes 325 created in the ball 305. The vacuum itself can be controlled by a servo motor or dynamically increased or decreased. In some cases, the vacuum may be momentarily negative; that is, blowing away the fabric 830. The budger 300 has demonstrated effectiveness at moving and steering fabric 830 at rates of speed up to 160 in/sec, but with some slippage, which can create errors in moving the fabric 830. Hence, vision feedback from the overhead vision module 240 can correct the motion error created by the budger 300 and control the budger 300 to move the fabric 830 in a desirable direction.

Alternatively or additionally, the driving motor can be placed inside the ball 305. Alternatively or additionally, electro-static force can be used in place of or in addition to vacuum. The voltages used may also be varied, much as with the vacuum. Alternatively or additionally, the budger 300 can be moved from place to place by a separate motion device, usually servo controlled. Thus, the budger 300 can become a type of robotic end of arm tooling and can be positioned above the fabric 830. (Above and below refer to the direction of gravity). Alternatively or additionally, the budger with the robotic end of arm tooling can freeze and thaw liquid to engage and move the fabric 830. The liquid can be water. The budger can include a contact surface that engages the fabric 830 and is maintained by thermo-couple effect close to the freezing temperature so that minimal energy and time is spent to freeze and thaw the liquid. The contact surface of the budger is controlled by provision of a liquid or gas on the side opposite the fabric 830. The liquid that is frozen and thawed is made available by osmosis or similar mechanism with the objective of keeping the surface damp but not dripping and to minimize the amount of liquid that are frozen and thawed.

Alternatively or additionally, the budger can utilize a servo controlled belt (instead of the ball 305) protruding or within a table surface 335 that is in contact with the fabric 830 for the purpose of moving and/or providing force to the fabric 830. Note that in this case the budger may be very low in height relative to the surface contact area. Alternatively or additionally, the budger can utilize a thin arm riding on the table surface for the purpose of moving and/or providing force to the fabric 830, where provision is made to minimize the disturbance of the fabric 830 caused by the arm motion. The arm itself can be a type of robotic arm tooling supported by the table surface 335 and thus can be very thin itself. The thin arm can generate air flow at the tip of the arm for friction minimization, thus, creating an air film between the arm and the fabric 830. The thin arm can include an oscillating plate with provision for preferential direction of motion. Such oscillations are known in the art, for example, a vibratory feeder.

The motors 310 that control the budgers 300 can include position sensors (not shown) in order to follow a given trajectory. However, due to the nonlinear mechanical properties and variety of fabric 830, and noticeable slippage between the budgers 300 and fabric 830, the system 100 can use the overhead vision module 240 to generate position feedback of the fabric 830 that facilitates in monitoring the movement of the fabric 830. The overhead vision module 240 can observe the position, alignment, and shape of the fabric 830 in order for the fabric 830 to remain align during the garment making process.

The ability of a single budger 300 can steer a square piece of cloth to quickly move forward to the left or to the right. With two or more budgers 300 coordinated in their action, near arbitrary translation and rotation including rotating in place can occur. The coordination of two or more balls 305 is similar to the coordination of independent steering of multiple wheels on a vehicle in which the vehicle is upside down and subject to the same holonomic constraints. Driving the balls 305 in a holonomic fashion is also feasible but can complicate the construction of the budger 300.

Figure 4:
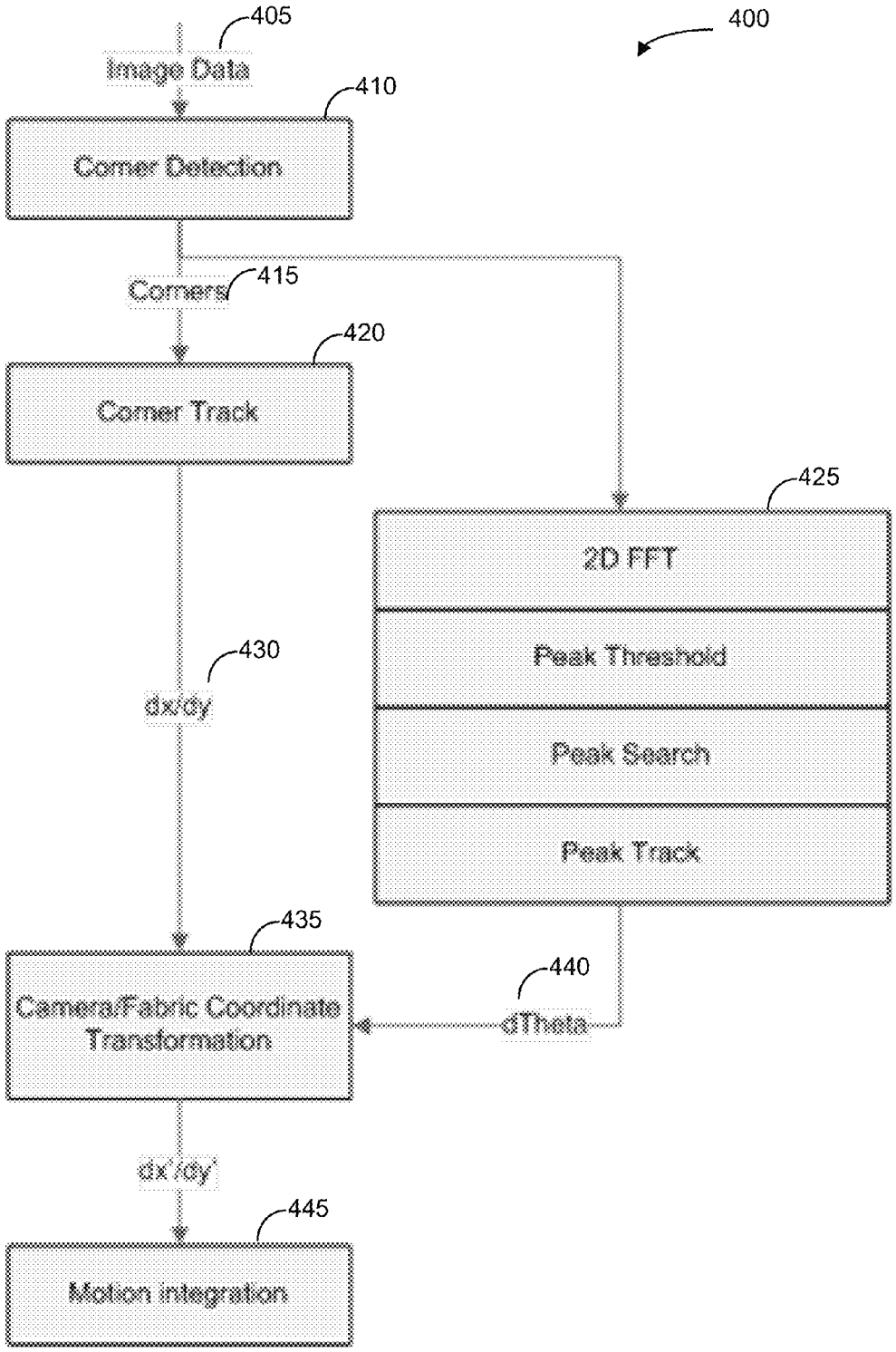
FIG. 4 is a flow diagram that illustrates an embodiment of a thread counting vision algorithm that can be stored and implemented at a thread-level vision module, such as that shown in FIG. 2.

FIG. 4 is a flow diagram that illustrates an embodiment of a thread counting vision algorithm 400 that can be stored in memory at a thread-level vision module 245, such as that shown in FIG. 2. The system 100 for making garment is based on the ability to reliably "count threads" in the fabric work pieces. More specifically, this refers to an exemplary process of the following:

- continuously monitoring a small region of fabric 830 (FIG. 8) in the immediate vicinity of the servo controlled dog 230 (which may be either cutting or sewing), and
- allowing for local deformation of that region of fabric 830 so that the center point is kept within the proper context of the non-Euclidean thread-based coordinate system relative to an original starting point or datum, maintaining:
  1) The cumulative number of warp threads that have passed the center point,
  2) The cumulative number of fill threads that have passed the center point, and
  3) The six degrees of freedom the fabric 830 (FIG. 8) might exhibit on a table surface 810; the six degrees of freedome include two directions of translation (a) (b), one direction of rotation (c), two directions of stretch (d) (e) and one direction of shear (f).

It should be noted that the cumulative count includes both positive and negative increments. The third criteria above, maintaining at least an approximate angular orientation, can help determine whether the passage of a thread represents a warp or a fill, and whether it is a positive or negative increment. A more precise estimate of angular orientation can be used to rotate the dogs 230 for closed-loop control of stitch patterns at arbitrary angles relative to a warp and/or a fill.

The thread-counting process can include fast imaging devices and moderately priced computational hardware that allow both sensing and computation to be performed in a small unit that can be replicated numerous times throughout a production machine. For example, CMOS imaging devices are now commercially available that are capable of exceeding 1500 frames per second. The imaging device can capture an image, such as that shown in FIG. 4, and process the captured imaged into image data 405.

A high frame rate of the image data 405 is used to recognize very small motion (less than the width of a thread) in successive frames, e.g., to satisfy the Shannon sampling theorem as it applies to the spatial frequencies of the image. The image data 405 is sent to a corner detection unit 410 which extracts corners 415 from the image data 405. Two parallel algorithms can estimate translation and rotation, respectively. Both utilize corner features resulting from, for example, a Harris corner detection algorithm not only because corners are generally strong invariant features, but also because weave patterns exhibit them in abundance. No assumption can be made that all corners will be detected or that the same corners will appear in successive frames. One assumption can be made that only a very large number of the same corners will appear in successive frames. Alternatively or additionally, an intersection detection unit (not shown) can be used to facilitate detecting the position of the fabric 830. It should be noted that any features or characteristics, such the weft and warp, of the fabric 830 can be used to facilitate detecting the position of the fabric 830

Figure 5:
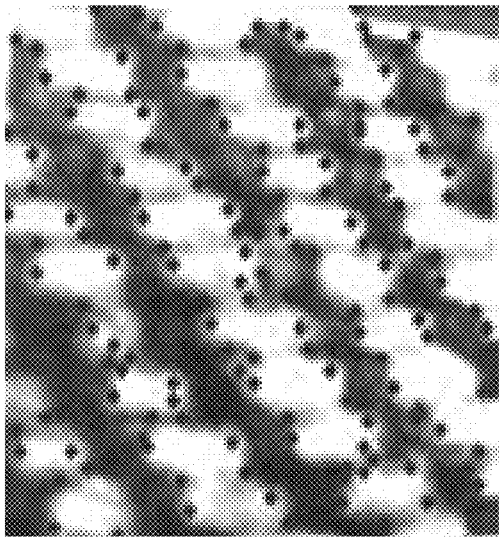
FIG. 5 is an example of an image of a fabric (i.e., denim) with features resulting from a Harris corner detector superimposed.
Figure 6:
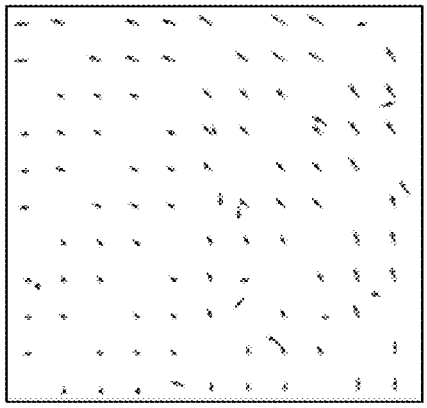
FIG. 6 is an example of a corner translation that is shown as vectors, which are associated with corners of two successive frames of corner features captured from a fabric, such as that shown in FIG. 5.

A corner track unit 420 is used to detect fabric translation, measured at the center of the image (corresponding to the center of the dog's local coordinate system). The process is illustrated with images in FIGS. 5 and 6, which are generated from simulated frames that include deliberate noise and miscorrelation. On the left of FIG. 6, two successive frames are compared to find the pairwise sets of nearest corners in each frame. Each set results in a vector that describes the hypothesized motion during the frame interval at that point on the fabric 830. Some of the correlations appear incorrect in the left diagram, but even more so in the right diagram, where the average translation across the image was computed and subtracted from each vector. The miscorrelated pairs can be eliminated, and a more accurate average translation can be determined, resulting in dx/dy pattern 430, as shown in FIG. 4. This enables not only discrete thread counting, but actually fractional thread counting. A camera/fabric coordination transformation unit 435 determines a coordinate transformation between the camera frame of reference and the fabric 830 itself based on dx/dy pattern 430 and an estimation of the fabric rotation (dTheta) 440, which is described further below in connection with a fabric rotation estimation unit 425. The coordinate transformation is sent to a motion integration unit 445 that coordinates the functionality and operations of the various other components (e.g., fabric sewing coordination module 215, sewing machine 235 and servo dog 230) of the system 100 to achieve an automated garment making process.

Figure 7:
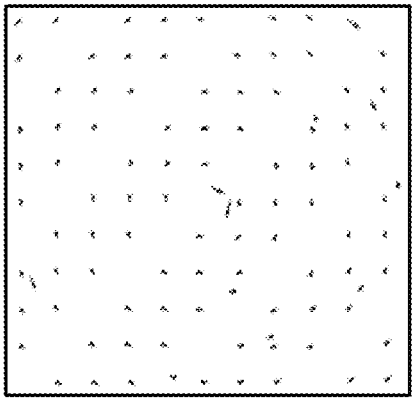
FIG. 7 is an example of a fabric rotation that is shown as vectors, which are associated with an estimation of a fabric rotation and some obviously miscorrelated corner features (which can optionally be removed)

It is possible to estimate differential rotation as part of the same algorithm that computes translation, such as that shown in FIG. 7. But better results, free of accumulating incremental errors, can be attained by considering the weave pattern. Whereas the dx/dy pattern 430 is small and repeats so often as to be unrecognizable from frame to frame due to aliasing, the rotational orientation is easily recognizable in successive frames as long as differential rotation is less than 45 degrees. So, the fabric rotation estimation unit 425 can include a conventional approach of taking a two dimensional fast Fourier transform (2D FFT), resulting in strong peaks corresponding to the spatial frequencies of the warp and fill threads. Tracking the corresponding angular orientation of these peaks in the spatial image from one frame to the next ensures that the fabric angle is estimated correctly.

Figure 9:
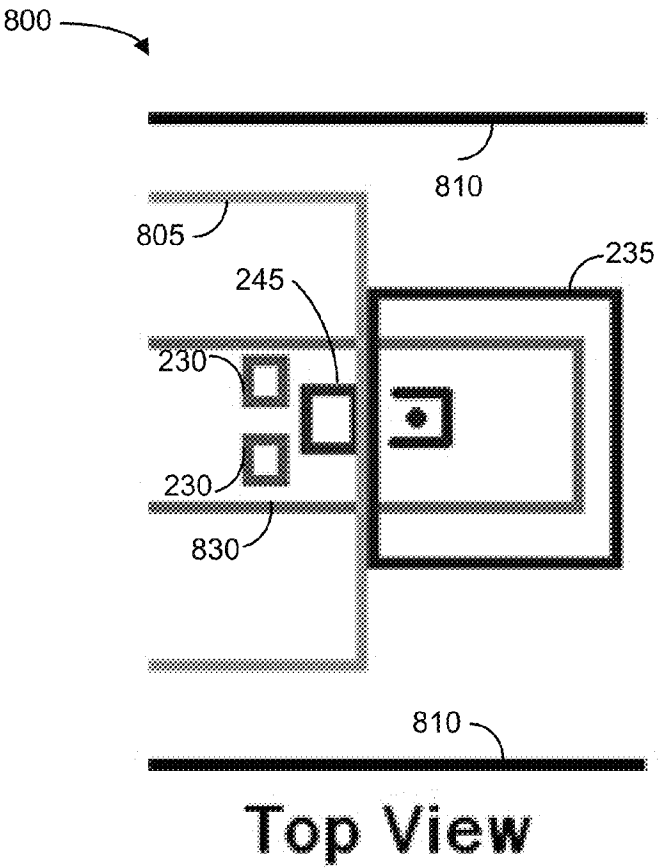
FIGS. 8 and 9 are side and top views that illustrate an embodiment of a fabric sewing section of the garment making system having a servo controlled dog, thread-level vision module, and sewing machine, such as that shown in FIG. 2.
Figure 8:
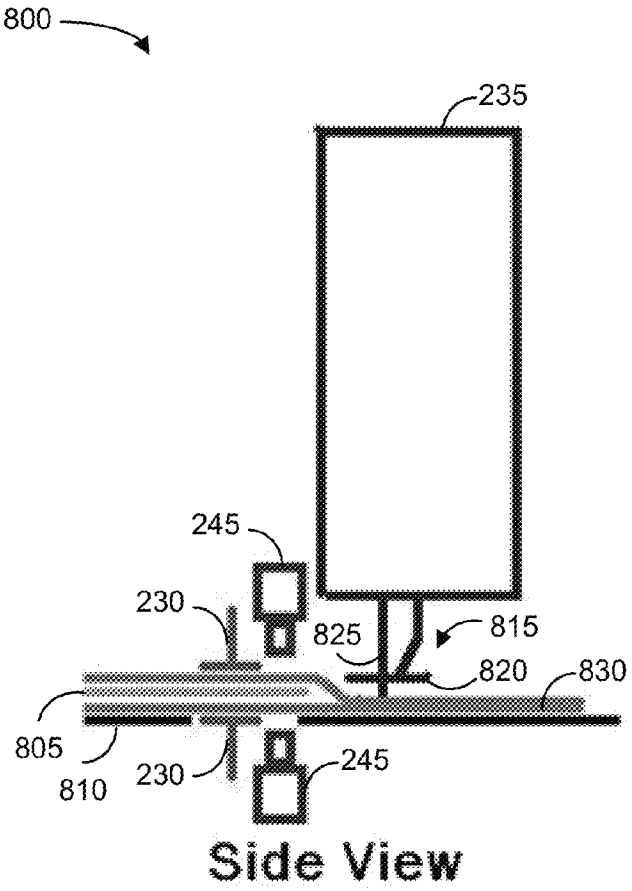

FIGS. 8 and 9 are side and top views that illustrate an embodiment of a fabric sewing section 800 of the garment making system 100 having a servo controlled dog 230, thread-level vision module 245, and sewing machine 235, such as that shown in FIG. 2. The fabric sewing section 800 includes a thin plate 805 located above the table surface 810 in front of the sewing head 815, one or two servo controlled dogs 230 above and below the thin plate 805 with approximately two to three degrees of freedom each, and two thread-level vision modules 245 to provide position feedback based on fabric threads.

In the examples shown in FIGS. 8 and 9, the servo controlled dogs 230 are located in front of the needle 825 in order to be able to advance the fabric 830 before the fabric 830 reaches the needle 825. The servo controlled dogs 230 are mounted above the fabric 830 and push down against the surface 810 of the table. This lowers the demands of moving the fabric 830 on the budgers 300.

Alternatively or additionally, a presser foot 820 can be designed to move up and down in time with the needle 825 so that it can hold the fabric 830 while the needle 825 makes a stitch but release the fabric 830 to allow the servo controlled dogs 230 to push the fabric 830 through the sewing head 815. The fabric sewing section 800 can be effectively addressed and resolved the problem of current automated sewing.

Alternatively or additionally, the servo controlled dogs 230 can use adhesion, viscosity liquid, and viscoelastic on a surface of the dogs 230 that engages the fabric 830 and "grip" the fabric better to move the fabric 830. Alternatively or additionally, the surface of the servo controlled dogs 230 that engages the fabric 830 can include needles that penetrate a portion of the fabric 830 to "grip" and move the fabric 830. Another way to grip the fabric 830 is to freeze liquid to the fabric and surface of the servo controlled dogs 230. To release the fabric 830 from the frozen liquid, the liquid is thawed at the surface of the servo controlled dogs 230.

Figure 10:
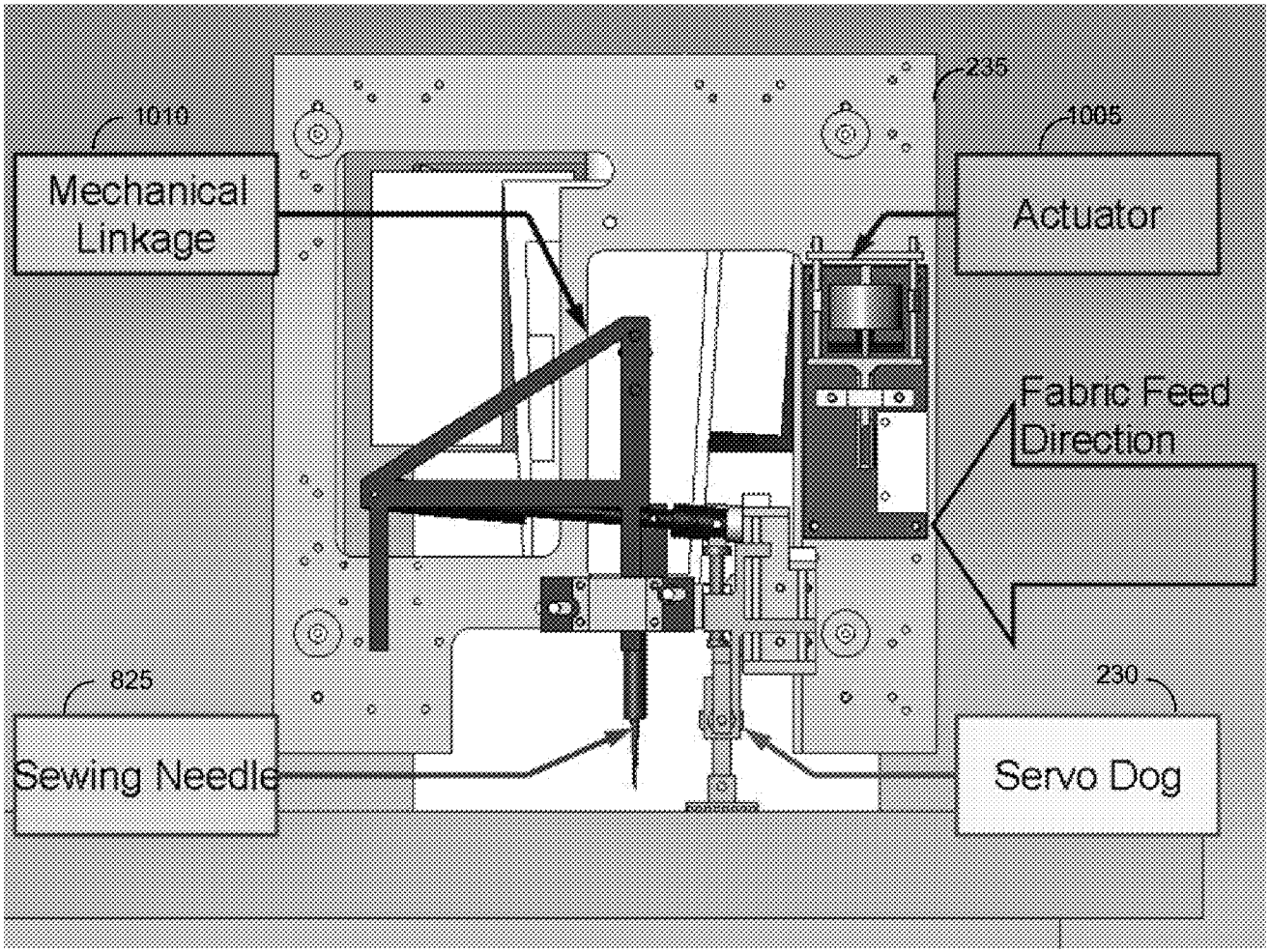
FIGS. 10 and 11 are cross-sectional views that illustrate an embodiment of a servo controlled dog mounted at a sewing machine, such as that shown in FIGS. 8 and 9.
Figure 11:
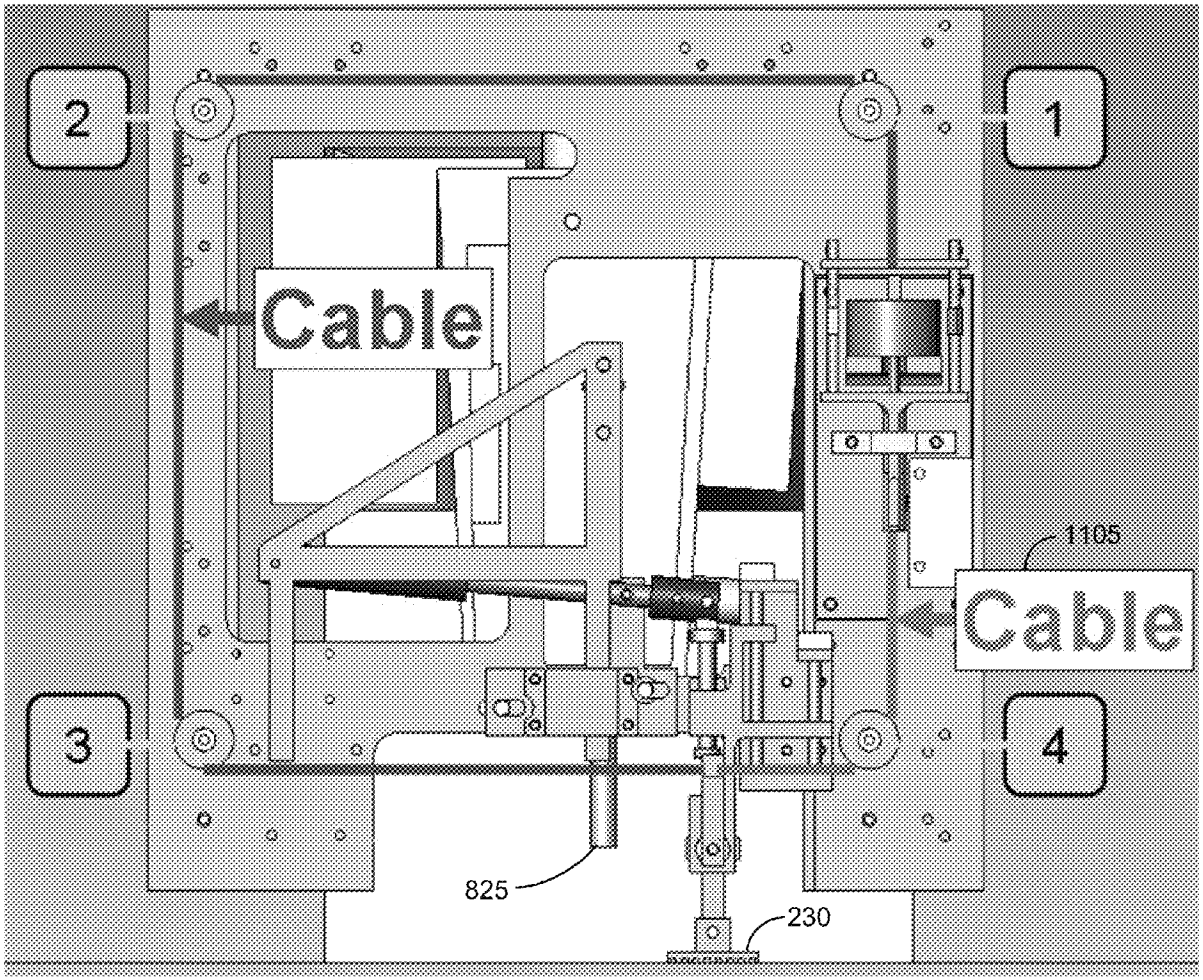
Figure 13:
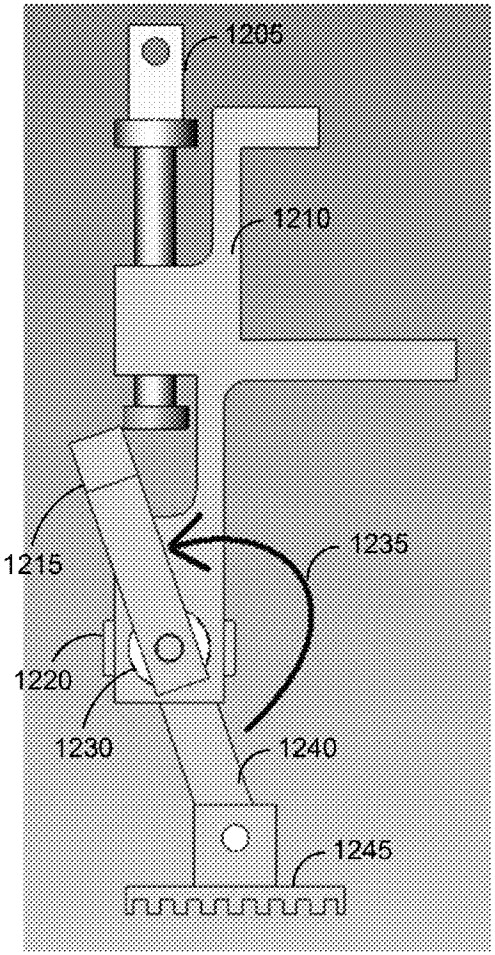
FIGS. 12-15 are perspective, side, and top views that illustrate an embodiment of a servo controlled dog, such as that shown in FIGS. 10 and 11.
Figure 12:
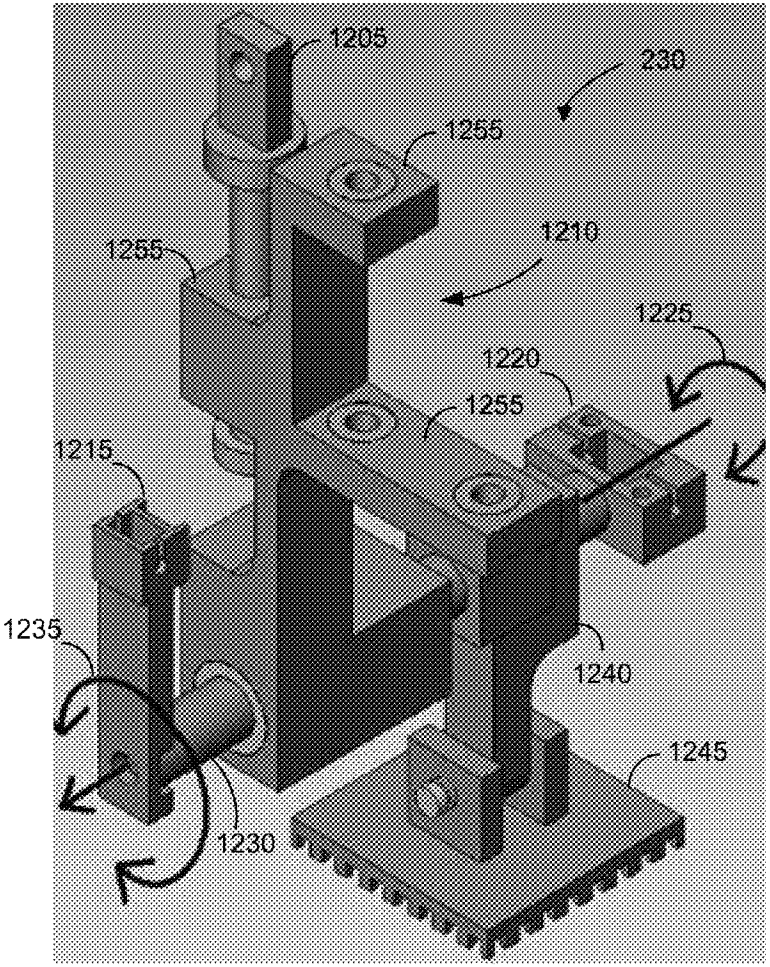
Figure 15:
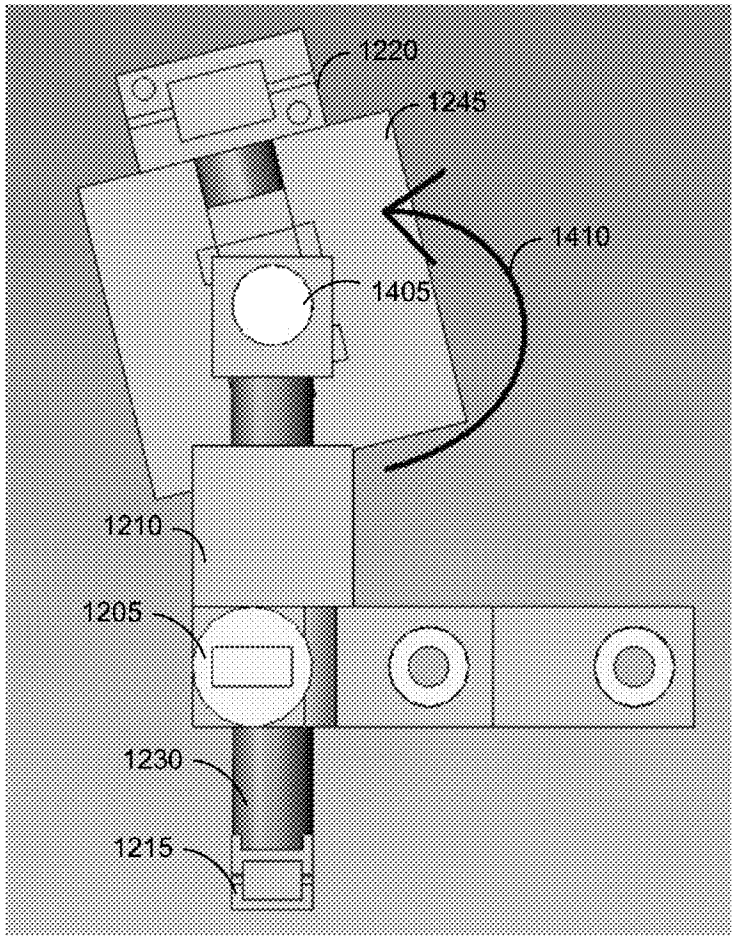
Figure 14:
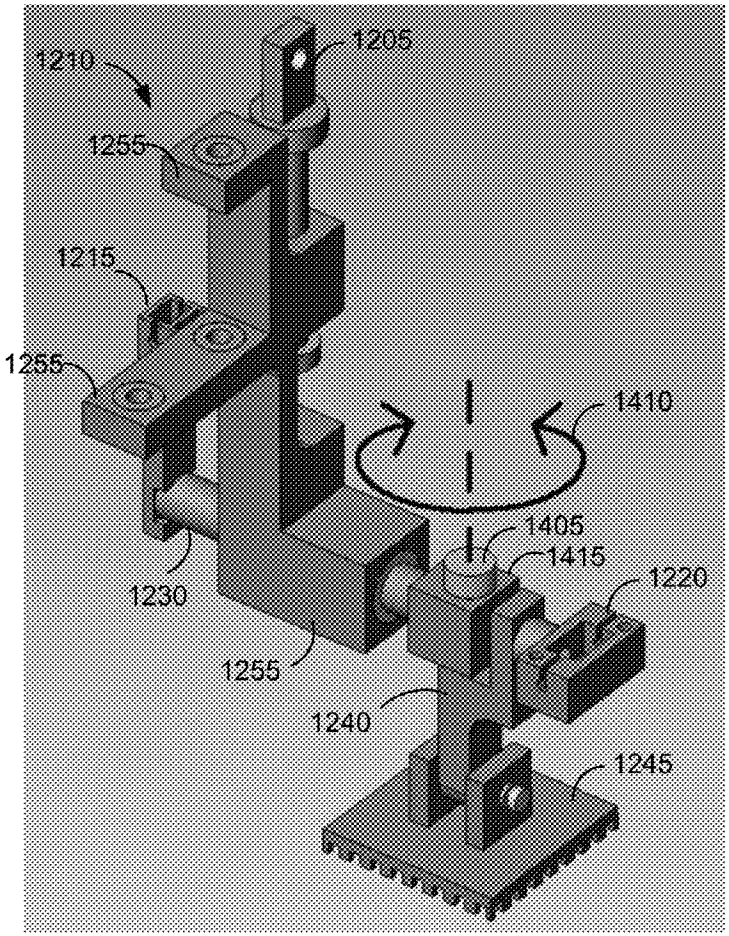

FIGS. 10 and 11 are cross-sectional views that illustrate an embodiment of a servo controlled dog 230 mounted on a sewing machine 235, such as that shown in FIGS. 8 and 9. The servo controlled dog 230 can be designed to have two degrees of freedom, which in this example is the minimum number of degrees of freedom for controlling a fabric sheet on a surface. The servo controlled dog 230 can use two voice coil motors (part of an actuator 1005) and a cable drive system 1105 to transfer power to the servo controlled dog 230 while allowing the motor 1005 to be mounted apart from the servo controlled dog 230. Note that moving coil does not need to imply circular construction but rather than the armature consists largely of wire. The voice coil motor can have a peak force of approximately 10 N and a total travel of approximately 4 mm at a force greater than approximately 90% of the peak force. The system 100 can use linear optical encoders (not shown) for position control of the voice coil motors 1005, and the position control of the fabric 830 can use open loop control. The position control of the fabric 830 can be provided by the thread counting vision system. The needle-to-dog linkage system 1010 mechanically connects the servo controlled dog 230 to the sewing needle 825, facilitating proper timing between the dog 230 and needle 825.

Alternatively or additionally, a single servo controlled dog 230 can be used to achieve both forward and reverse motion and rotation, resulting in two degrees of freedom. This is sufficient for obtaining in-plane motion but cannot stretch or skew the fabric 830. The entire device can be mounted on an industrial sewing machine 235 that had been modified to allow for the servo controlled dog 230. For out-of-plane motion, the servo controlled dog 230 is mechanically attached to the sewing needle 825 to force proper timing between the contacts of the servo controlled dog 230 and needle 825 with the fabric 830.

The cable drive system shown in FIG. 11 connects power from the actuators 1005 to the servo controlled dog 230. This can permit the actuators 1005 to be mounted separately from the dog 230 if desired. Neither motor has to be able to move both the dog 230 and another motor to obtain two independently actuated degrees of freedom. This is considered a lightweight method of transferring power. The use of cables 1105 can also permit the dog 230 to move up and down while keeping the actuators 1005 stationary, and can allow the actuators 1005 to control the dog 230 regardless of whether it is up, down, or in motion. Because of the change in distance as the dog 230 moves up and down, albeit small, the cable 1105 should be designed to be flexible, such as with flexible threads or cords.

FIGS. 12-15 are perspective, side, and top views that illustrate an embodiment of a servo controlled dog 230, such as that shown in FIGS. 10 and 11. The assembly of the servo controlled dog 230 includes an elongated body 1210 that has several horizontal bars, at least one of which includes a vertical bore that is inserted with a cylindrical bar 1205. A bottom horizontal bar further includes a horizontal bore that is inserted with a cylindrical bar 1230. A lever 1215 and a supporting bar 1415 (FIG. 14) are attached to a proximal end and a distal end of the cylindrical bar 1230, respectively. The supporting bar 1415 includes a vertical bore that is inserted with a vertical cylindrical bar 1405, which is attached to a vertical supporting bar 1240. Such vertical supporting bar 1240 is attached to an arm 1220 and a flat plate 1245. The lever 1215 and the arm 1220 can be coupled to the actuator 1005 via a linkage system to move the flat plate 1245 of the dog 230, driving the translation motion and a rotation motion of the dog 230, respectively. The two motions are decoupled, meaning that the rotation is unaffected by the translation. To reduce the difficulty of implementation, the entire dog assembly can be designed to rotate on a vertical cylindrical pin 1205.

The movement of the servo controlled dog 230 is determined by the travel distance of the stitch length anticipated for an application. Typical sewing speeds for non-autonomous sewing can be up to approximately 5,000 stitches per minute, which translates to approximately 80 stitches per second. Assuming an average stitch length of approximately two (2) millimeters, the servo actuators 1005 can accelerate up to approximately 23 g's or 225 m/s2 in order to simulate the speed of the current manual sewing process. In this example, the accuracy of the dog's motion is proportional to the stitch length of travel because large variations in stitch length and stitch position can cause unacceptably poor seam quality. Hence, the position accuracy should be on the order of fractions of a millimeter.

Figure 16:
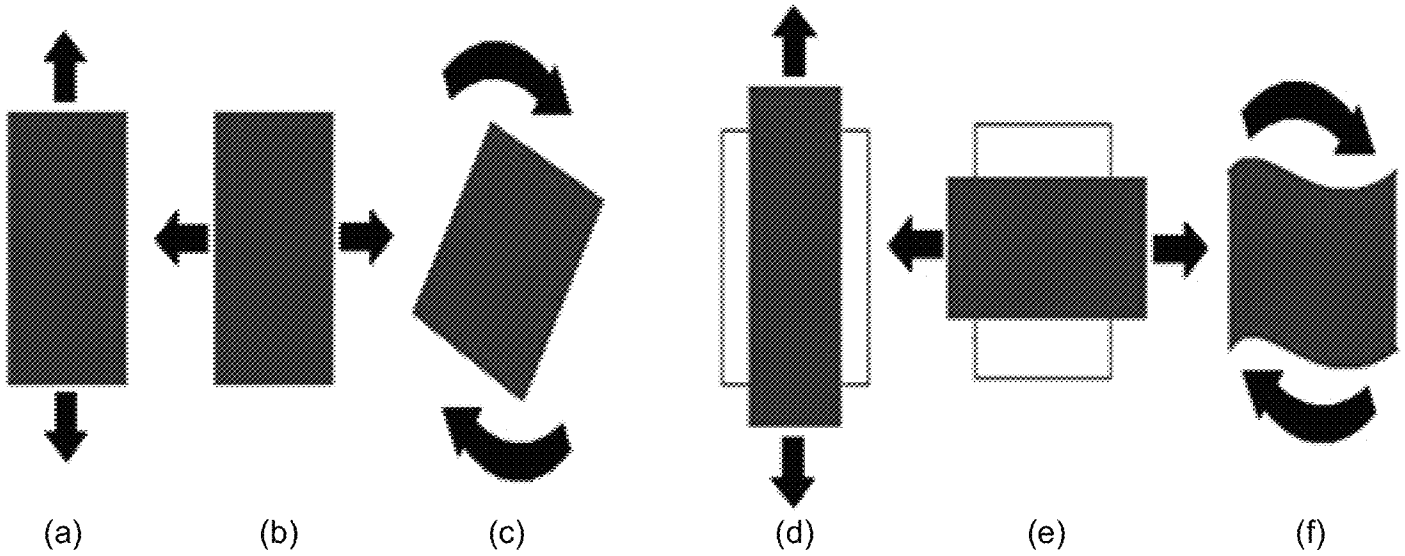
FIG. 16 depicts the six different degrees of freedom that a fabric might exhibit on a table surface using a servo controlled dog, such as that shown in FIGS. 10 and 11.

FIG. 16 depicts the six different degrees of freedom that the fabric 830 (FIG. 8) might exhibit on a table surface 810 (FIG. 8) using a servo controlled dog 230, such as that shown in FIGS. 10 and 11. The degrees of freedom include two directions of translation (a) (b), one direction of rotation (c), two directions of stretch (d) (e) and one direction of shear (f). If one can assume that, with respect to the servo controlled dogs 230, the stretch and skew are negligible and that the fabric 830 can be oriented to the sewing head 815 and feed into it, then the servo controlled dogs 230 can generate three degrees of freedom described above, e.g., forward/back and rotate, on the fabric 830. However, because the fabric 830 has the potential to buckle and stretch at the sewing head 815, the three degrees associated with fabric deformation are controlled and monitored by the thread-level vision module 245.

Figure 17:
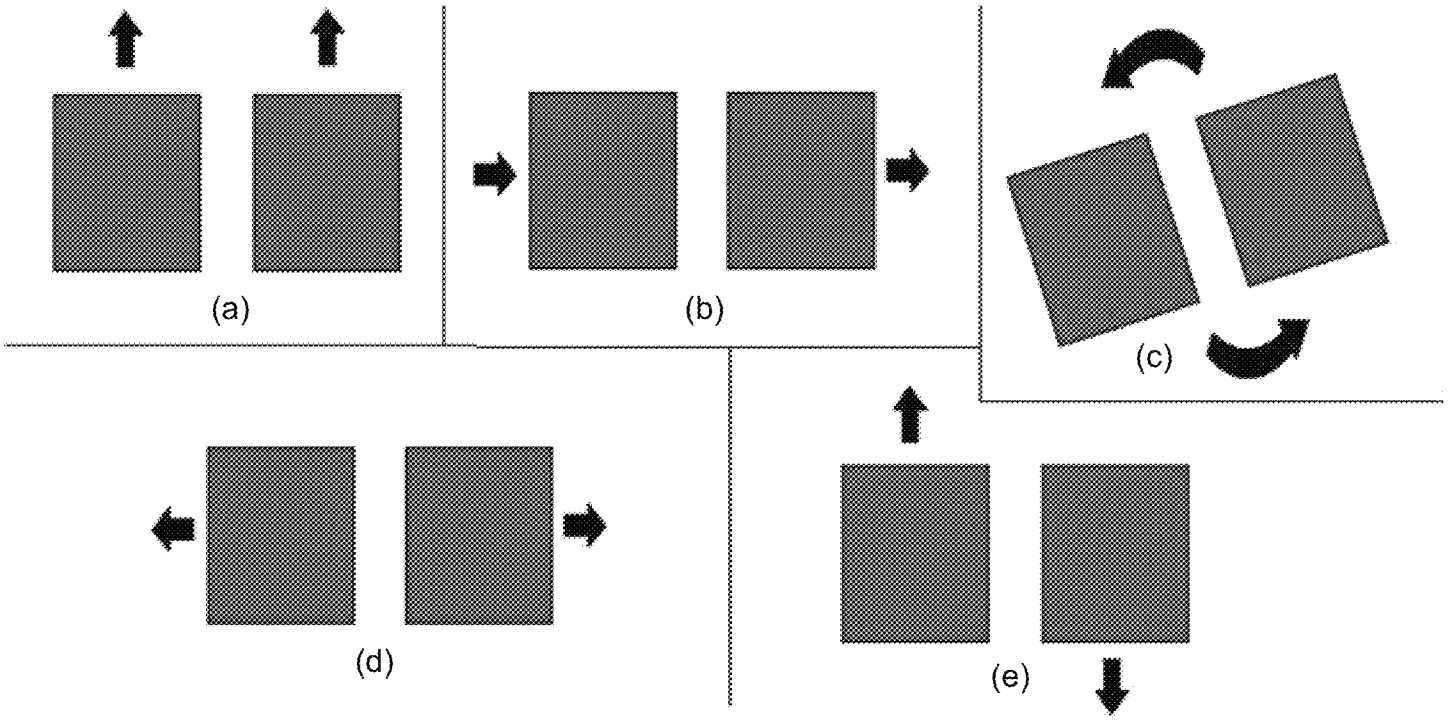
FIG. 17 depicts movements of two servo controlled dogs to obtain six degrees of freedom.

FIG. 17 depicts movements of two servo controlled dogs 230 to obtain six degrees of freedom. The blocks represent the servo controlled dogs 230 and the arrows show how five degrees of freedom can be controlled: translation up/back (a), translation left/right (b), rotation (c), stretch in one direction (d), and shear (e). The sixth degree of freedom is the fabric tension in the direction parallel to the sewing line, which can be maintained using coordinated control between the dogs 230 and the budgers 300.

Figure 18:
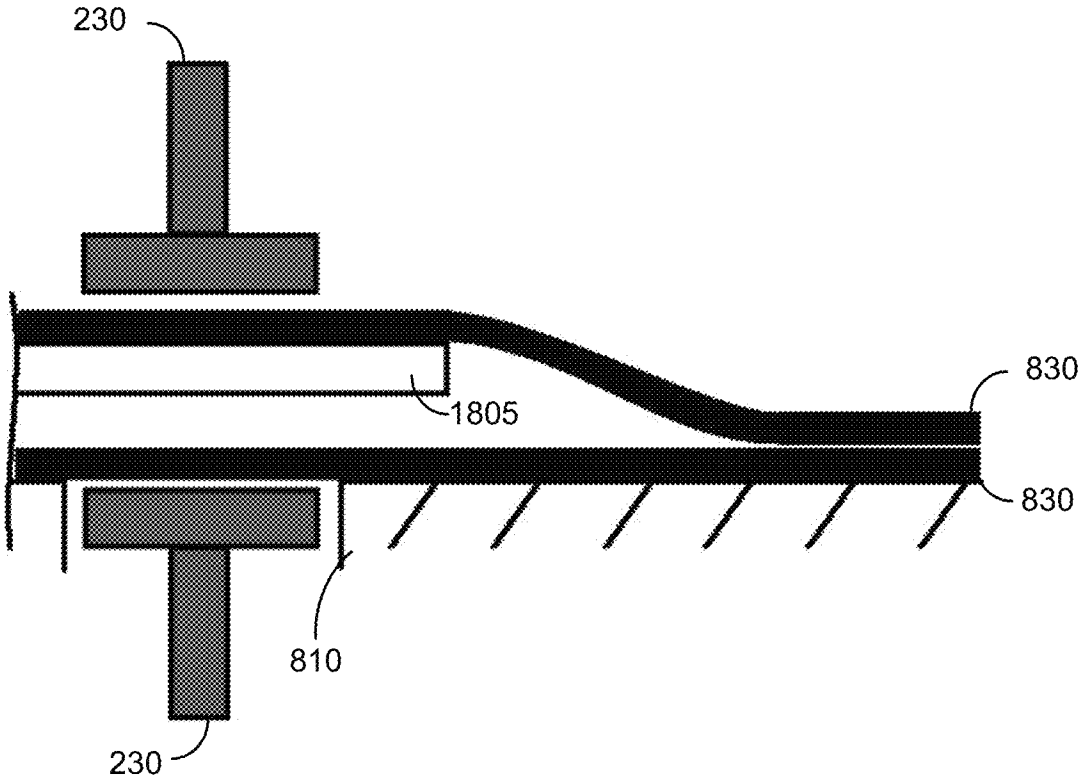
FIG. 18 is a view that illustrates an embodiment of the servo controlled dogs, such as that shown in FIG. 8.

FIG. 18 is a view that illustrates an embodiment of the servo controlled dogs 230, such as that shown in FIG. 8. In addition to orienting the fabric 830 (FIG. 8) in multiple degrees of freedom, the servo controlled dogs 230 can control two sheets of fabric 830. The two sheets can be separated with a surface in between them, such as a thin steel plate 1805. The servo controlled dogs 230 are positioned above and below the plate 1805, one set of two dogs for each ply of fabric 830. The servo controlled dogs 230 positioned above and below the plate 1805 are in contact with an upper layer and lower layer of the fabric 830, respectively. The tangential force at the dogs 230 from the fabric 830 can be measured to allow some evaluation of the sewing conditions. That information may influence future motions of dogs 230 and/or motions external to the sewing head 815, such as the budgers 300. The tangential force measurement can be determined at least in part by observing the electrical current required to move the servo controlled dogs 230 properly.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention.

What is claimed is:

1. A conveyance system that transports fabric comprising:
a work space having a surface that the fabric can be transports across; and
at least one budger that includes a motor that spins a ball in a servo controlled motion, wherein the ball comes into contact with the fabric to move and/or provide force to the fabric.

2. The conveyance system as defined in claim 1, wherein the budger creates a vacuum that is used to enhance the driving force to move the fabric.

3. The conveyance system as defined in claim 1, further comprising a driving motor that is placed inside the ball to spin the ball in the servo controlled motion.

4. The conveyance system as defined in claim 1, wherein the budger generates electro-static force that is used to enhance the driving force to move the fabric.

5. The conveyance system as defined in claim 1, further comprising a driving motor that is placed externally from the ball to spin the ball in the servo controlled motion.

6. The conveyance system as defined in claim 1, wherein the budger is located in a stationary position relative to the sewing head.

7. The conveyance system as defined in claim 1, wherein the budger is moved from place to place by a robotic end of arm tooling.

8. A conveyance system that transports fabric comprising:
a work space having a surface that the fabric can be transports across; and
at least one budger that moves and/or provide force to the fabric in a servo controlled motion.

9. The conveyance system as defined in claim 8, wherein the budger includes a servo controlled belt protruding or within a surface that is in contact with cloth for the purpose of moving and/or providing force to the fabric.

10. The conveyance system as defined in claim 8, wherein the budger includes a thin arm riding on the surface of the work space for the purpose of moving and/or providing force to the fabric.

11. The conveyance system as defined in claim 10, wherein the thin arm generates air flow by creating an air film between the arm and the fabric.

12. The conveyance system as defined in claim 10, wherein the thin arm includes an oscillating plate with provision for preferential direction of motion.

13. The conveyance system as defined in claim 8, wherein the budger includes a motor that spins in a servo controlled motion, wherein the ball protrudes out of the at least one opening of the surface of the work space, wherein the ball comes into contact with the fabric to move and/or provide force to the fabric.

14. The conveyance system as defined in claim 13, wherein the budger creates a vacuum that is used to enhance the driving force to move the fabric.

15. The conveyance system as defined in claim 13, further comprising a driving motor that is placed inside the ball to spin the ball in the servo controlled motion.

16. The conveyance system as defined in claim 13, wherein the budger generates electro-static force that is used to enhance the driving force to move the fabric.

17. A conveyance system that transports fabric comprising:

a work space having a surface that the fabric can be transports across, wherein the surface includes at least one opening; and at least one budger that is moved from place to place by a robotic end of arm tooling, wherein the budger freezes and thaws liquid to engage and move the fabric.

18. The conveyance system as defined in claim 17, wherein the budger includes a contact surface that contacts with the fabric and is maintained by thermo-couple effect close to the freezing temperature.

19. The conveyance system as defined in claim 18, wherein the contact surface of the budger is controlled by provision of a liquid or gas on the side opposite the fabric.

20. The conveyance system as defined in claim 19, wherein the liquid that is frozen and thawed is made available by osmosis or similar mechanism with the objective of keeping the surface damp and to minimize the amount of liquid that are frozen and thawed.

* * * * *